US009689590B2

(12) United States Patent
Christensen

(10) Patent No.: US 9,689,590 B2
(45) Date of Patent: Jun. 27, 2017

(54) $CO_2$ REFRIGERATION SYSTEM WITH INTEGRATED AIR CONDITIONING MODULE

(71) Applicant: Hill Phoenix, Inc., Conyers, GA (US)

(72) Inventor: Kim G. Christensen, Aarhus V (DK)

(73) Assignee: Hill Phoenix, Inc., Conyers, GA (US)

( * ) Notice: Subject to any disclaimer, the term of this patent is extended or adjusted under 35 U.S.C. 154(b) by 472 days.

(21) Appl. No.: 13/886,868

(22) Filed: May 3, 2013

(65) Prior Publication Data

US 2013/0298593 A1 Nov. 14, 2013

Related U.S. Application Data

(60) Provisional application No. 61/646,082, filed on May 11, 2012, provisional application No. 61/651,341,
(Continued)

(51) Int. Cl.
*F25B 9/00* (2006.01)
*F25B 1/10* (2006.01)
*F25B 40/00* (2006.01)

(52) U.S. Cl.
CPC ..... *F25B 9/008* (2013.01); *F25B 1/10* (2013.01); *F25B 40/00* (2013.01);
(Continued)

(58) Field of Classification Search
CPC . F24F 2005/0039; F25B 9/008; F25B 41/043; F25B 2400/06; F25B 2400/075; F25B 2400/23
See application file for complete search history.

(56) References Cited

U.S. PATENT DOCUMENTS 5,134,859 A * 8/1992 Jaster ..... F25B 5/04 62/198
5,184,473 A * 2/1993 Day ..... F25B 5/04 62/199

(Continued)

FOREIGN PATENT DOCUMENTS

JP 2002-195688 7/2002
JP 2004-257694 9/2004

(Continued)

OTHER PUBLICATIONS

International Search Report and Written Opinion for International Application No. PCT/US2013/039453, dated Sep. 17, 2013, 14 pages.

(Continued)

*Primary Examiner* — Etsub Berhanu
*Assistant Examiner* — Nelson Nieves
(74) *Attorney, Agent, or Firm* — Foley & Lardner LLP

(57) ABSTRACT

An integrated $CO_2$ refrigeration and air conditioning (AC) system for use in a facility includes one or more $CO_2$ compressors configured to discharge a $CO_2$ refrigerant at a higher pressure for circulation through a circuit to provide cooling to one or more refrigeration loads in the facility and a receiver configured to receive the $CO_2$ refrigerant at a lower pressure through a high pressure valve. The integrated system further includes an AC module configured to deliver a chilled AC coolant to AC loads in the facility. The AC module includes an AC evaporator and an AC compressor. The AC evaporator has an inlet configured to receive $CO_2$ liquid and an outlet configured to discharge a $CO_2$ vapor. The AC compressor is arranged in parallel with the one or more $CO_2$ compressors and is configured to receive $CO_2$ vapor from both the AC evaporator and the receiver.

11 Claims, 4 Drawing Sheets

Related U.S. Application Data filed on May 24, 2012, provisional application No. 61/668,803, filed on Jul. 6, 2012.

(52) U.S. Cl.
CPC . *F25B 2309/061* (2013.01); *F25B 2400/0751* (2013.01); *F25B 2400/13* (2013.01); *F25B 2400/23* (2013.01); *F25B 2600/17* (2013.01); *F25B 2600/2501* (2013.01)

(56) References Cited

U.S. PATENT DOCUMENTS 5,287,705 A * 2/1994 Roehrich et al. ..... 62/50.3
5,365,744 A * 11/1994 Viegas et al. ..... 62/50.3
6,276,152 B1 8/2001 Sibik
6,722,156 B2 4/2004 Tanimoto et al.
7,467,525 B1 * 12/2008 Ohta ..... F25B 5/02 62/498
2004/0020223 A1 * 2/2004 Doi et al. ..... 62/225
2005/0034473 A1 * 2/2005 Casar ..... B60H 1/00899 62/324.1
2008/0110200 A1 * 5/2008 Javerschek ..... F25B 9/008 62/515
2008/0196420 A1 * 8/2008 Gernemann ..... F25B 9/008 62/117
2008/0264077 A1 * 10/2008 Heinbokel ..... F25B 9/008 62/115
2008/0289350 A1 * 11/2008 Shapiro ..... 62/246
2008/0307805 A1 * 12/2008 Gupte ..... F25B 1/10 62/117
2009/0019878 A1 1/2009 Gupte
2009/0095005 A1 * 4/2009 Dietrich ..... B60H 1/00907 62/244
2009/0120108 A1 * 5/2009 Heinbokel et al. ..... 62/78
2009/0175748 A1 * 7/2009 Bush et al. ..... 418/5
2010/0005831 A1 * 1/2010 Vaisman et al. ..... 62/470
2010/0018668 A1 * 1/2010 Favrat ..... F24D 7/00 165/48.1
2010/0199707 A1 * 8/2010 Pearson ..... 62/434
2010/0223939 A1 * 9/2010 Mitra et al. ..... 62/117
2010/0229582 A1 * 9/2010 Yamada ..... F25B 1/10 62/238.7
2011/0011104 A1 * 1/2011 Lesage et al. ..... 62/81
2011/0314846 A1 * 12/2011 Heinbokel et al. ..... 62/115
2012/0022706 A1 * 1/2012 Fan ..... F25B 41/062 700/282
2012/0055182 A1 * 3/2012 Dube ..... 62/81
2012/0073319 A1 * 3/2012 Dube ..... 62/235

FOREIGN PATENT DOCUMENTS

JP 2006-308166 11/2006
JP 2007-051788 3/2007
WO WO-2009/041959 4/2009
WO WO-2009/086493 7/2009

OTHER PUBLICATIONS

International Preliminary Report on Patentability for PCT Application No. PCT/US2013/039453, mail date Nov. 20, 2014, 12 pages.
Extended European Search Report for EP Application No. 13787848.4, mail date Mar. 10, 2016, 7 pages.

* cited by examiner

$CO_2$ REFRIGERATION SYSTEM WITH INTEGRATED AIR CONDITIONING MODULE

CROSS-REFERENCE TO RELATED PATENT APPLICATIONS

The present Application claims the benefit of and priority to U.S. Provisional Application No. 61/646,082 filed May 11, 2012, U.S. Provisional Application No. 61/651,341 filed May 24, 2012, and U.S. Provisional Application No. 61/668,803 filed Jul. 6, 2012. U.S. Provisional Applications Nos. 61/646,082, 61/651,341, and 61/668,803 are hereby incorporated by reference in their entireties.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this Application and is not admitted to be prior art by inclusion in this section.

The present disclosure relates generally to a refrigeration system primarily using carbon dioxide (i.e., $CO_2$) as a refrigerant. The present disclosure relates more particularly to a $CO_2$ refrigeration system for supermarkets or like facilities, the refrigeration system having a flexible module that provides cooling for air conditioning ("AC") loads of the facility. The present disclosure relates more particularly to an AC module having an evaporator (e.g., an AC chiller, a fan-coil unit, etc.) to receive the $CO_2$ refrigerant and a compressor operating in parallel with compressors of the $CO_2$ refrigeration system.

Refrigeration systems that provide cooling to temperature controlled display devices (e.g. cases, merchandisers, etc.) in supermarkets or similar facilities typically operate independently from air conditioning systems used to cool the facilities during warm or humid weather (e.g. in warmer climates, during daily or seasonal temperature variations, etc.). Further, such refrigeration systems and air conditioning systems are typically not integrated in a manner that increases the efficiency of the system(s) or that provides flexible modularity in the way that the systems are integrated.

Accordingly, it would be desirable to provide a $CO_2$ refrigeration system having a flexible module for integrating the cooling of air conditioning loads in a manner that increases the efficiency of the systems.

SUMMARY

One implementation of the present disclosure is an integrated $CO_2$ refrigeration and air conditioning (AC) system for use in a facility. The integrated system includes one or more $CO_2$ compressors configured to discharge a $CO_2$ refrigerant at a higher pressure for circulation through a circuit to provide cooling to one or more refrigeration loads in the facility and a receiver configured to receive the $CO_2$ refrigerant at a lower pressure through a high pressure valve. The receiver has a $CO_2$ liquid portion and a $CO_2$ vapor portion.

The integrated system further includes an AC module configured to deliver a chilled AC coolant to AC loads in the facility. The AC module includes an AC evaporator and an AC compressor. The AC evaporator has an inlet configured to receive $CO_2$ liquid and an outlet configured to discharge a $CO_2$ vapor. The AC compressor is arranged in parallel with the one or more $CO_2$ compressors and is configured to receive $CO_2$ vapor from both the AC evaporator and the receiver.

Another implementation of the present disclosure is another integrated CO2 refrigeration and air conditioning system for use in a facility. The integrated system includes a $CO_2$ refrigeration circuit configured to circulate a $CO_2$ refrigerant to refrigeration loads in the facility and an AC module configured to deliver a chilled AC coolant to AC loads in the facility.

The $CO_2$ refrigeration circuit includes a plurality of parallel $CO_2$ compressors, a gas cooler/condenser, a receiver having a $CO_2$ vapor portion and a $CO_2$ liquid portion, and a $CO_2$ liquid supply line. The $CO_2$ liquid supply line is coupled to the $CO_2$ liquid portion of the receiver and configured to direct $CO_2$ liquid to one or more refrigeration loads in the facility.

The AC module includes an AC evaporator and an AC compressor. The AC evaporator has an inlet configured to receive the $CO_2$ refrigerant from the $CO_2$ refrigeration circuit and an outlet configured to discharge the $CO_2$ refrigerant. The AC compressor is arranged in parallel with the plurality of parallel $CO_2$ compressors, the AC compressor configured to receive $CO_2$ vapor from both the AC evaporator and the receiver.

Another implementation of the present disclosure is yet another integrated $CO_2$ refrigeration and air conditioning system for use in a facility. The integrated system includes a $CO_2$ refrigeration circuit configured to circulate a $CO_2$ refrigerant to refrigeration loads in the facility and an AC module integrated with the $CO_2$ refrigeration circuit and configured to provide cooling for AC loads in the facility.

The $CO_2$ refrigeration circuit includes a $CO_2$ compressor configured to discharge the $CO_2$ refrigerant at a first pressure into a first fluid line and a receiver configured to receive the $CO_2$ refrigerant at a second pressure lower than the first pressure. The receiver has a $CO_2$ liquid portion and a $CO_2$ vapor portion. The $CO_2$ refrigeration circuit further includes a high pressure valve disposed between the $CO_2$ compressor and the receiver. The high pressure valve is configured to receive the $CO_2$ refrigerant at the first pressure from a second fluid line and discharge the $CO_2$ refrigerant to the second pressure.

The AC module includes an AC evaporator configured to receive $CO_2$ refrigerant from a component of the $CO_2$ refrigeration circuit and transfer heat to the $CO_2$ refrigerant. The component of the $CO_2$ refrigeration circuit from which the $CO_2$ refrigerant is received is selected from a group consisting of: the second fluid line, the $CO_2$ liquid portion of the receiver, and the high pressure valve. The AC module further includes an AC compressor arranged in parallel with the $CO_2$ compressor. The AC compressor is configured to receive vapor $CO_2$ refrigerant from the $CO_2$ vapor portion of the receiver and to discharge vapor $CO_2$ refrigerant into the first fluid line.

Those skilled in the art will appreciate that the foregoing summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
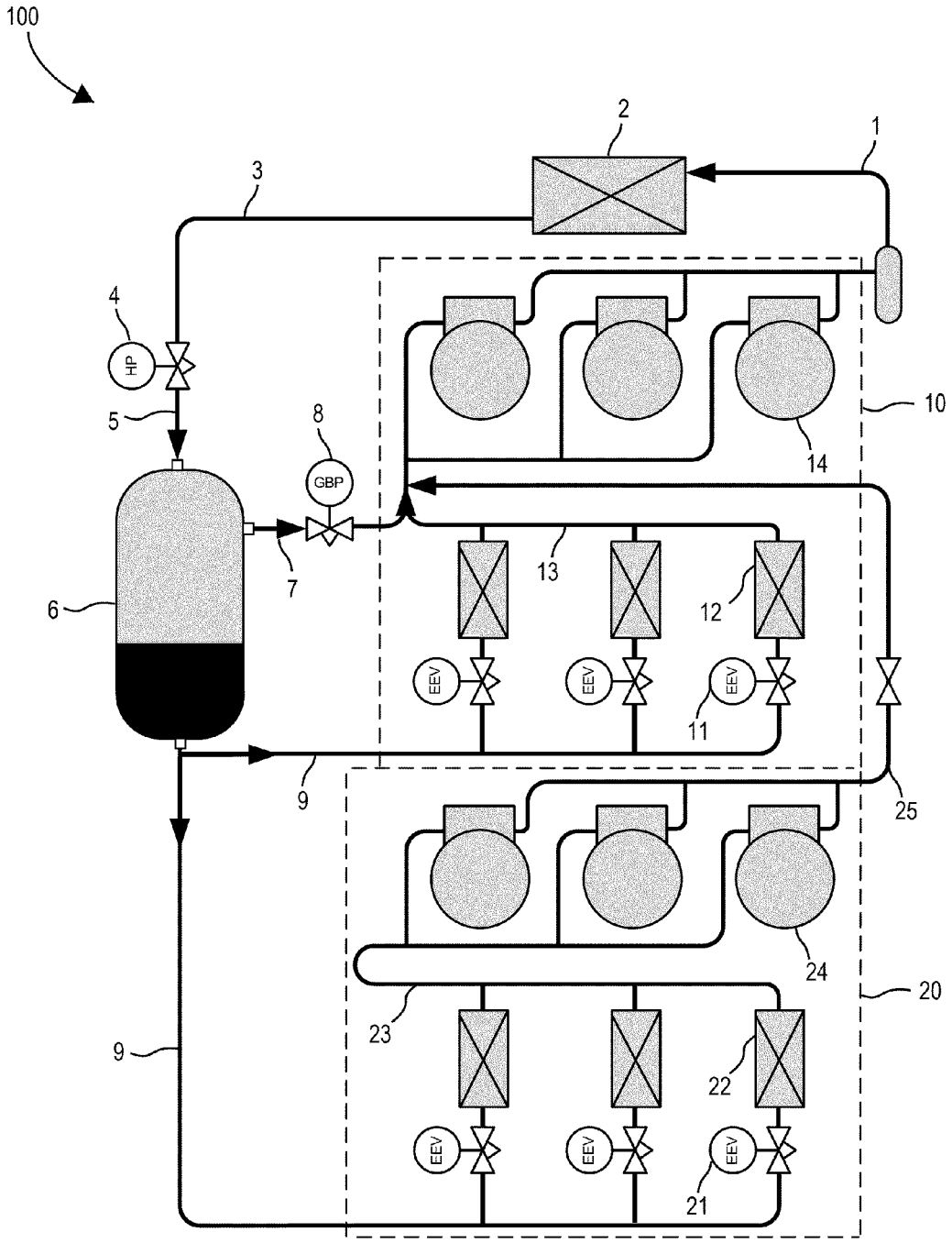
FIG. 1 is a schematic representation of a $CO_2$ refrigeration system having a low temperature ("LT") system portion for cooling LT loads (e.g. LT evaporators in LT display devices) and a medium temperature ("MT") system portion for cooling MT loads (e.g. MT evaporators in MT display devices) in a facility such as a supermarket or the like, according to an exemplary embodiment.

Referring generally to the FIGURES, a $CO_2$ refrigeration system is shown, according to various exemplary embodiments. The $CO_2$ refrigeration system may be used to provide cooling for temperature controlled display devices in a supermarket or similar facility. Advantageously, the $CO_2$ refrigeration system may include one or more flexible air conditioning modules (i.e., "AC modules") for integrating air conditioning loads (i.e., "AC loads") or other loads associated with cooling the facility. The flexible AC modules may be desirable when the facility is located in warmer climates, or locations having daily or seasonal temperature variations that make air conditioning desirable within the facility. The flexible AC modules are "flexible" in the sense that they may have any of a wide variety of capacities by varying the size, capacity, and number of heat exchangers and/or compressors provided within the AC modules.

In some embodiments, the flexible AC modules are adapted to conveniently interconnect (e.g. "plug-and-play") with the piping of an existing $CO_2$ refrigeration system when integration is desirable for an intended facility or application. For example, the flexible AC modules may be integrated with an existing $CO_2$ refrigeration system by forming only a relatively small number (e.g., 2-3) of connections between the flexible AC modules and the $CO_2$ refrigeration system. To further increase convenience, the flexible AC modules may be connected with the existing $CO_2$ refrigeration system using quick-disconnects, flexible hoses/connections, "plug-and-play" adapters, or other convenient connection devices.

Advantageously, the AC modules may enhance or increase the efficiency of the systems (e.g., the $CO_2$ refrigeration system, the AC system, the combined system, etc.) by the synergistic effects of combining the source of cooling for both systems in a parallel compression arrangement. In some embodiments, an AC compressor may be used to draw uncondensed $CO_2$ vapor from a receiving tank (e.g., a flash tank, the "receiver," etc.) as a means for pressure control and regulation within the receiving tank. Using the AC compressor to effectuate pressure control and regulation may provide a more efficient alternative to other pressure regulation techniques such as bypassing $CO_2$ vapor through a bypass valve to the lower pressure suction side of the $CO_2$ refrigeration system compressors.

Although the various embodiments of the disclosure are described in terms of supermarket facilities, temperature controlled display devices and air conditioning loads, other suitable loads for integration within a refrigeration system consistent with the principles described herein are intended to be within the scope of this disclosure. Further, specific temperatures and/or pressures described herein are intended as illustrative only and are not intended to be limiting, as other pressure and/or temperature ranges may be used to suit other system variations or applications.

Referring more particularly to FIG. 1, a $CO_2$ refrigeration system 100 is shown according to an exemplary embodiment. $CO_2$ refrigeration system 100 may be a vapor compression refrigeration system which uses primarily carbon dioxide as a refrigerant. $CO_2$ refrigeration system 100 and is shown to include a system of pipes, conduits, or other fluid channels (e.g., fluid conduits 1, 3, 5, 7, and 9) for transporting the carbon dioxide between various thermodynamic components the refrigeration system. The thermodynamic components of $CO_2$ refrigeration system 100 are shown to include a gas cooler/condenser 2, a high pressure valve 4, a receiving tank 6, a gas bypass valve 8, a medium-temperature ("MT") system portion 10, and a low-temperature ("LT") system portion 20.

Gas cooler/condenser 2 may be a heat exchanger or other similar device for removing heat from the $CO_2$ refrigerant. Gas cooler/condenser 2 is shown receiving $CO_2$ vapor from fluid conduit 1. In some embodiments, the $CO_2$ vapor in fluid conduit 1 may have a pressure within a range from approximately 45 bar to approximately 100 bar (i.e., about 640 psig to about 1420 psig), depending on ambient temperature and other operating conditions. In some embodiments, gas cooler/condenser 2 may partially or fully condense $CO_2$ vapor into liquid $CO_2$ (e.g., if system operation is in a subcritical region). The condensation process may result in fully saturated $CO_2$ liquid or a liquid-vapor mixture (e.g., having a thermodynamic quality between 0 and 1). In other embodiments, gas cooler/condenser 2 may cool the $CO_2$ vapor (e.g., by removing superheat) without condensing the $CO_2$ vapor into $CO_2$ liquid (e.g., if system operation is in a supercritical region). In some embodiments, the cooling/condensation process is an isobaric process. Gas cooler/condenser 2 is shown outputting the cooled and/or condensed $CO_2$ refrigerant into fluid conduit 3.

High pressure valve 4 receives the cooled and/or condensed $CO_2$ refrigerant from fluid conduit 3 and outputs the $CO_2$ refrigerant to fluid conduit 5. High pressure valve 4 may control the pressure of the $CO_2$ refrigerant in gas cooler/condenser 2 by controlling an amount of $CO_2$ refrigerant permitted to pass through high pressure valve 4. In some embodiments, high pressure valve 4 is a high pressure thermal expansion valve (e.g., if the pressure in fluid conduit 3 is greater than the pressure in fluid conduit 5). In such embodiments, high pressure valve 4 may allow the $CO_2$ refrigerant to expand to a lower pressure state. The expansion process may be an isenthalpic and/or adiabatic expansion process, resulting in a flash evaporation of the high pressure $CO_2$ refrigerant to a lower pressure, lower temperature state. The expansion process may produce a liquid/vapor mixture (e.g., having a thermodynamic quality between 0 and 1). In some embodiments, the $CO_2$ refrigerant expands to a pressure of approximately 38 bar (e.g., about 540 psig), which corresponds to a temperature of approximately 37° F. The $CO_2$ refrigerant then flows from fluid conduit 5 into receiving tank 6.

Receiving tank 6 collects the $CO_2$ refrigerant from fluid conduit 5. In some embodiments, receiving tank 6 may be a flash tank or other fluid reservoir. Receiving tank 6 includes a CO2 liquid portion and a CO2 vapor portion and may contain a partially saturated mixture of $CO_2$ liquid and $CO_2$ vapor. In some embodiments, receiving tank 6 separates the $CO_2$ liquid from the $CO_2$ vapor. The $CO_2$ liquid may exit receiving tank 6 through fluid conduits 9. Fluid conduits 9 may be liquid headers leading to either MT system portion 10 or LT system portion 20. The $CO_2$ vapor may exit receiving tank 6 through fluid conduit 7. Fluid conduit 7 is shown leading the $CO_2$ vapor to gas bypass valve 8.

Gas bypass valve 8 is shown receiving the $CO_2$ vapor from fluid conduit 7 and outputting the $CO_2$ refrigerant to MT system portion 10. In some embodiments, gas bypass valve 8 regulates or controls the pressure within receiving tank 6 by controlling an amount of $CO_2$ refrigerant permitted to pass through gas bypass valve 8 (e.g., by regulating a position of gas bypass valve 8). Gas bypass valve 8 may open and close as needed to regulate the pressure within receiving tank 6. In some embodiments, gas bypass valve 8 may be a thermal expansion valve (e.g., if the pressure on the downstream side of gas bypass valve 8 is lower than the pressure in fluid conduit 7). According to one embodiment, the pressure within receiving tank 6 is regulated by gas bypass valve 8 to a pressure of approximately 38 bar, which corresponds to about 37° F. Advantageously, this pressure/temperature state (i.e., approximately 38 bar, approximately 37° F.) may facilitate the use of copper tubing/piping for the downstream $CO_2$ lines of the system. Additionally, this pressure/temperature state may allow such copper tubing to operate in a substantially frost-free manner.

Still referring to FIG. 1, MT system portion 10 is shown to include one or more expansion valves 11, one or more MT evaporators 12, and one or more MT compressors 14. In various embodiments, any number of expansion valves 11, MT evaporators 12, and MT compressors 14 may be present. Expansion valves 11 may be electronic expansion valves or other similar expansion valves. Expansion valves 11 are shown receiving liquid $CO_2$ refrigerant from fluid conduit 9 and outputting the $CO_2$ refrigerant to MT evaporators 12. Expansion valves 11 may cause the $CO_2$ refrigerant to undergo a rapid drop in pressure, thereby expanding the $CO_2$ refrigerant to a lower pressure, lower temperature state. In some embodiments, expansion valves 11 may expand the $CO_2$ refrigerant to a pressure of approximately 30 bar. The expansion process may be an isenthalpic and/or adiabatic expansion process.

MT evaporators 12 are shown receiving the cooled and expanded $CO_2$ refrigerant from expansion valves 11. In some embodiments, MT evaporators may be associated with display cases/devices (e.g., if $CO_2$ refrigeration system 100 is implemented in a supermarket setting). MT evaporators 12 may be configured to facilitate the transfer of heat from the display cases/devices into the $CO_2$ refrigerant. The added heat may cause the $CO_2$ refrigerant to evaporate partially or completely. According to one embodiment, the $CO_2$ refrigerant is fully evaporated in MT evaporators 12. In some embodiments, the evaporation process may be an isobaric process. MT evaporators 12 are shown outputting the $CO_2$ refrigerant via fluid conduits 13, leading to MT compressors 14.

MT compressors 14 compress the $CO_2$ refrigerant into a superheated vapor having a pressure within a range of approximately 45 bar to approximately 100 bar. The output pressure from MT compressors 14 may vary depending on ambient temperature and other operating conditions. In some embodiments, MT compressors 14 operate in a transcritical mode. In operation, the $CO_2$ discharge gas exits MT compressors 14 and flows through fluid conduit 1 into gas cooler/condenser 2.

Still referring to FIG. 1, LT system portion 20 is shown to include one or more expansion valves 21, one or more LT evaporators 22, and one or more LT compressors 24. In various embodiments, any number of expansion valves 21, LT evaporators 22, and LT compressors 24 may be present. In some embodiments, LT system portion 20 may be omitted and the $CO_2$ refrigeration system 100 may operate with an AC module interfacing with only MT system 10.

Expansion valves 21 may be electronic expansion valves or other similar expansion valves. Expansion valves 21 are shown receiving liquid $CO_2$ refrigerant from fluid conduit 9 and outputting the $CO_2$ refrigerant to LT evaporators 22. Expansion valves 21 may cause the $CO_2$ refrigerant to undergo a rapid drop in pressure, thereby expanding the $CO_2$ refrigerant to a lower pressure, lower temperature state. The expansion process may be an isenthalpic and/or adiabatic expansion process. In some embodiments, expansion valves 21 may expand the $CO_2$ refrigerant to a lower pressure than expansion valves 11, thereby resulting in a lower temperature $CO_2$ refrigerant. Accordingly, LT system portion 20 may be used in conjunction with a freezer system or other lower temperature display cases.

LT evaporators 22 are shown receiving the cooled and expanded $CO_2$ refrigerant from expansion valves 21. In some embodiments, LT evaporators may be associated with display cases/devices (e.g., if $CO_2$ refrigeration system 100 is implemented in a supermarket setting). LT evaporators 22 may be configured to facilitate the transfer of heat from the display cases/devices into the $CO_2$ refrigerant. The added heat may cause the $CO_2$ refrigerant to evaporate partially or completely. In some embodiments, the evaporation process may be an isobaric process. LT evaporators 22 are shown outputting the $CO_2$ refrigerant via fluid conduit 23, leading to LT compressors 24.

LT compressors 24 compress the $CO_2$ refrigerant. In some embodiments, LT compressors 24 may compress the $CO_2$ refrigerant to a pressure of approximately 30 bar (e.g., about 425 psig) having a saturation temperature of approximately 23° F. (e.g., about −5° C.). LT compressors 24 are shown outputting the $CO_2$ refrigerant through fluid conduit 25. Fluid conduit 25 may be fluidly connected with the suction (e.g., upstream) side of MT compressors 14.

In some embodiments, the $CO_2$ vapor that is bypassed through gas bypass valve 8 is mixed with the $CO_2$ refrigerant gas exiting MT evaporators 12 (e.g., via fluid conduit 13). The bypassed $CO_2$ vapor may also mix with the discharge $CO_2$ refrigerant gas exiting LT compressors 24 (e.g., via fluid conduit 25). The combined $CO_2$ refrigerant gas may be provided to the suction side of MT compressors 14.

Figure 2:
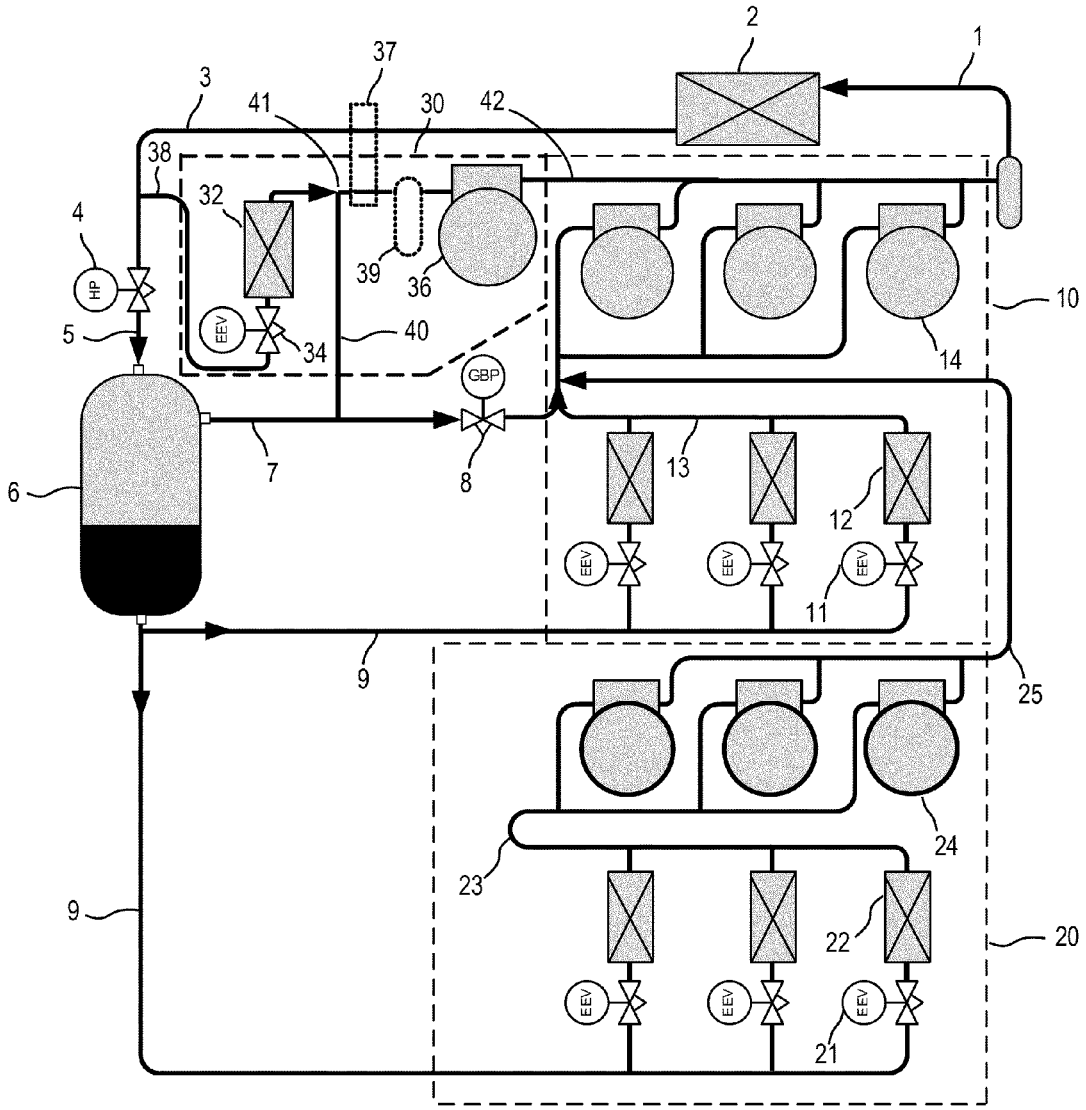
FIG. 2 is a schematic representation of the $CO_2$ refrigeration system of FIG. 1 having a flexible AC module for integrating cooling for air conditioning loads in the facility, according to an exemplary embodiment.

Referring now to FIG. 2, a flexible AC module 30 for integrating AC cooling loads in a facility with $CO_2$ refrigeration system 100 is shown, according to an exemplary embodiment. AC module 30 is shown to include an AC evaporator 32 (e.g., a liquid chiller, a fan-coil unit, a heat exchanger, etc.), an expansion device 34 (e.g. an electronic expansion valve), and at least one AC compressor 36. In some embodiments, flexible AC module 30 further includes a suction line heat exchanger 37 and $CO_2$ liquid accumulator 39. The size and capacity of the AC module 30 may be varied to suit any intended load or application by varying the number and/or size of evaporators, heat exchangers, and/or compressors within AC module 30.

Advantageously, AC module 30 may be readily connectible to $CO_2$ refrigeration system 100 using a relatively small number (e.g., a minimum number) of connection points. According to an exemplary embodiment, AC module 30 may be connected to $CO_2$ refrigeration system 100 at three connection points: a high-pressure liquid $CO_2$ line connection 38, a lower-pressure $CO_2$ vapor line (gas bypass)

connection 40, and a $CO_2$ discharge line 42 (to gas cooler/condenser 2). Each of connections 38, 40 and 42 may be readily facilitated using flexible hoses, quick disconnect fittings, highly compatible valves, and/or other convenient "plug-and-play" hardware components. In some embodiments, some or all of connections 38, 40, and 42 may be arranged to take advantage of the pressure differential between gas cooler/condenser 2 and receiving tank 6.

Still referring to FIG. 2, when AC module 30 is installed in $CO_2$ refrigeration system 100, AC compressor 36 may operate in parallel with MT compressors 14. For example, a portion of the high pressure $CO_2$ refrigerant discharged from gas cooler/condenser 2 (e.g., into fluid conduit 3) may be directed through $CO_2$ liquid line connection 38 and through expansion device 34. Expansion device 34 may allow the high pressure $CO_2$ refrigerant to expand a lower pressure, lower temperature state. The expansion process may be an isenthalpic and/or adiabatic expansion process. The expanded $CO_2$ refrigerant may then be directed into AC evaporator 32. In some embodiments, expansion device 34 adjusts the amount of $CO_2$ provided to AC evaporator 32 to maintain a desired superheat temperature at (or near) the outlet of the AC evaporator 32. After passing through AC evaporator 32, the $CO_2$ refrigerant may be directed through suction line heat exchanger 37 and $CO_2$ liquid accumulator 39 to the suction (i.e., upstream) side of AC compressor 36.

In some embodiments, AC evaporator 32 acts as a chiller to provide a source of cooling (e.g., building zone cooling, ambient air cooling, etc.) for the facility in which $CO_2$ refrigeration system 100 is implemented. In some embodiments, AC evaporator 32 absorbs heat from an AC coolant that circulates to the AC loads in the facility. In other embodiments, AC evaporator 32 may be used to provide cooling directly to air in the facility.

According to an exemplary embodiment, AC evaporator 32 is operated to maintain a $CO_2$ refrigerant temperature of approximately 37° F. (e.g., corresponding to a pressure of approximately 38 bar). AC evaporator 32 may maintain this temperature and/or pressure at an inlet of AC evaporator 32, an outlet of AC evaporator 32, or at another location within AC module 30. In other embodiments, expansion device 34 may maintain a desired $CO_2$ refrigerant temperature. The $CO_2$ refrigerant temperature maintained by AC evaporator 32 or expansion device 34 (e.g., approximately 37° F.) may be well-suited in most applications for chilling an AC coolant supply (e.g. water, water/glycol, or other AC coolant which expels heat to the $CO_2$ refrigerant). The AC coolant may be chilled to a temperature of about 45° F. or other temperature desirable for AC cooling applications in many types of facilities.

Advantageously, integrating AC module 30 with $CO_2$ refrigeration system 100 may increase the efficiency of $CO_2$ refrigeration system 100. For example, during warmer periods (e.g. summer months, mid-day, etc.) the $CO_2$ refrigerant pressure within gas cooler/condenser 2 tends to increase. Such warmer periods may also result in a higher AC cooling load required to cool the facility. By integrating AC module 30 with refrigeration system 100, the additional $CO_2$ capacity (e.g., the higher pressure in gas cooler/condenser 2) may be used advantageously to provide cooling for the facility. The dual effects of warmer environmental temperatures (e.g., higher $CO_2$ refrigerant pressure and an increased cooling load requirement) may both be addressed and resolved in an efficient and synergistic manner by integrating AC module 30 with $CO_2$ refrigeration system 100.

Additionally, according to the embodiment illustrated in FIG. 2, AC module 30 can be used to more efficiently regulate the $CO_2$ pressure in receiving tank 6. Such pressure regulation may be accomplished by drawing $CO_2$ vapor directly from the receiving tank 6 and avoiding (or minimizing) the need to bypass $CO_2$ vapor from the receiving tank 6 to the lower-pressure suction side of the MT compressors 14 (e.g., through gas bypass valve 8).

For example, in system configurations without AC module 30, gas bypass valve 8 operates (e.g. modulates) to bypass an amount of $CO_2$ vapor from receiving tank 6 to the suction side of MT compressors 14 as necessary to maintain or regulate the $CO_2$ refrigerant pressure within receiving tank 6. The $CO_2$ refrigerant pressure may drop when passing through gas bypass valve 8 (e.g., from approximately 38 bar (about 540 psig) to approximately 30 bar (about 425 psig)). Any $CO_2$ vapor bypassed from receiving tank 6 to the suction side of MT compressors 14 (e.g., through gas bypass valve 8) is necessarily re-compressed from the lower pressure of about 30 bar by the MT compressors 14.

Advantageously, when AC module 30 is integrated with $CO_2$ refrigeration system 100, $CO_2$ vapor from receiving tank 6 is provided through $CO_2$ vapor line connection 40 to the downstream side of AC evaporator 32 and the suction side of AC compressor 36. Such integration may establish an alternate (or supplemental) path for bypassing $CO_2$ vapor from receiving tank 6, as may be necessary to maintain the desired pressure (e.g., approximately 38 bar) within receiving tank 6. In some embodiments, AC module 30 draws its supply of $CO_2$ refrigerant from line 38, thereby reducing the amount of $CO_2$ that is received within receiving tank 6. In the event that the pressure in receiving tank 6 increases above the desired pressure (e.g. 38 bar, etc.), $CO_2$ vapor can be drawn by AC compressor 36 through $CO_2$ vapor line 40 in an amount sufficient to maintain the desired pressure within receiving tank 6. The ability to use the $CO_2$ vapor line 40 and AC compressor 36 as a supplemental bypass path for $CO_2$ vapor from receiving tank 6 provides a more efficient way to maintain the desired pressure in receiving tank 6 and avoids or minimizes the need to directly bypass $CO_2$ vapor across gas bypass valve 8 to the lower-pressure suction side of the MT compressors 14.

Still referring to FIG. 2, at intersection 41, the $CO_2$ vapor discharged from AC evaporator 32 may be mixed with $CO_2$ vapor output from receiving tank 6 (e.g., through fluid conduit 7 and vapor line 40, as necessary for pressure regulation). The mixed $CO_2$ vapor may then be directed through suction line heat exchanger 37 and liquid $CO_2$ accumulator 39 to the suction (e.g., upstream) side of AC compressor 36. AC compressor 36 compresses the mixed $CO_2$ vapor and discharges the compressed $CO_2$ refrigerant into connection line 42. Connection line 42 may be fluidly connected to fluid conduit 1, thereby forming a common discharge header with MT compressors 14. The common discharge header is shown leading to gas cooler/condenser 2 to complete the cycle.

Suction line heat exchanger 37 may be used to transfer heat from the high pressure $CO_2$ refrigerant exiting gas cooler/condenser 2 (e.g., via fluid conduit 3) to the mixed $CO_2$ refrigerant at or near intersection 41. Suction line heat exchanger 37 may help cool/sub-cool the high pressure $CO_2$ refrigerant in fluid conduit 3. Suction line heat exchanger 37 may also assist in ensuring that the $CO_2$ refrigerant approaching the suction of AC compressor 36 is sufficiently superheated (e.g., having a superheat or temperature exceeding a threshold value) to prevent condensation or liquid formation on the upstream side of AC compressor 36. In some embodiments, $CO_2$ liquid accumulator 39 may also be included to further prevent any $CO_2$ liquid from entering AC compressor 36.

Still referring to FIG. 2, AC module 30 may be integrated with $CO_2$ refrigeration system 100 such that integrated system can adapt to a loss of AC compressor 36 (e.g. due to equipment malfunction, maintenance, etc.), while still maintaining cooling for the AC loads and still providing $CO_2$ pressure control for receiving tank 6. For example, in the event that AC compressor 36 becomes non-functional, the $CO_2$ vapor discharged from AC evaporator 32 may be automatically (i.e. upon loss of suction from the AC compressor) directed back through $CO_2$ vapor line connection 40 toward fluid conduit 7. As the $CO_2$ refrigerant pressure increases in receiving tank 6 above the desired setpoint (e.g. 38 bar), the $CO_2$ vapor can be bypassed through gas bypass valve 8 and compressed by MT compressors 14. The parallel compressor arrangement of AC compressor 36 and MT compressors 14 allows for continued operation of AC module 30 in the event of an inoperable AC compressor 36.

Figure 3:
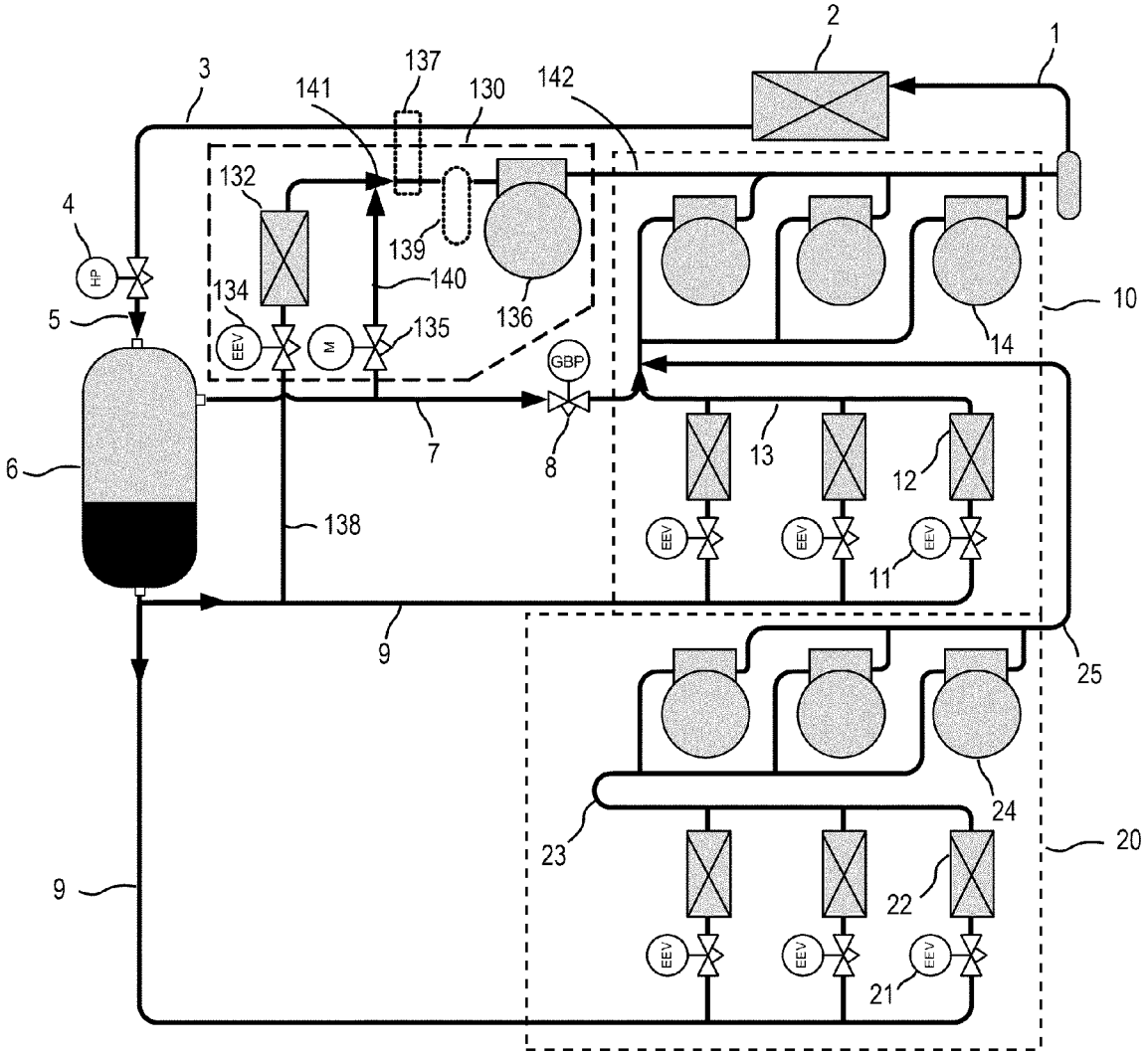
FIG. 3 is a schematic representation of the $CO_2$ refrigeration system of FIG. 1 having another flexible AC module for integrating cooling for air conditioning loads in the facility, according to another exemplary embodiment.

Referring now to FIG. 3, a flexible AC module 130 for integrating AC cooling loads in a facility with $CO_2$ refrigeration system 100 is shown, according to another exemplary embodiment. AC Module 130 is shown to include an AC evaporator 132 (e.g., a liquid chiller, a fan-coil unit, a heat exchanger, etc.), an expansion device 134 (e.g. an electronic expansion valve), and at least one AC compressor 136. In some embodiments, flexible AC module 30 further includes a suction line heat exchanger 137 and $CO_2$ liquid accumulator 139. AC evaporator 132, expansion device 134, AC compressor 136, suction line heat exchanger 137, and $CO_2$ liquid accumulator 139 may be the same or similar to analogous components (e.g., AC evaporator 32, expansion device 34, AC compressor 36, suction line heat exchanger 37, and $CO_2$ liquid accumulator 39) of AC module 30. The size and capacity of AC module 130 may be varied to suit any intended load or application (e.g., by varying the number and/or size of evaporators, heat exchangers, and/or compressors within AC module 130.

In some embodiments, AC module 130 is readily connectible to $CO_2$ refrigeration system 100 by a relatively small number (e.g., a minimum number) of connection points. According to an exemplary embodiment, AC module 130 may be connected to $CO_2$ refrigeration system 100 at three connection points: a liquid $CO_2$ line connection 138, a $CO_2$ vapor line connection 140, and a $CO_2$ discharge line 142. Liquid $CO_2$ line connection 138 is shown connecting to fluid conduit 9 and may receive liquid $CO_2$ refrigerant from receiving tank 6. $CO_2$ vapor line connection 140 is shown connecting to fluid conduit 7 and may receive $CO_2$ bypass gas from receiving tank 6. $CO_2$ discharge line 142 is shown connecting the output (e.g., downstream side) of AC compressor 136 to fluid conduit 1, leading to gas cooler/condenser 2. Each of connections 138, 140 and 142 may be readily facilitated using flexible hoses, quick disconnect fittings, highly compatible valves, and/or other convenient "plug-and-play" hardware components.

In operation, a portion of the liquid $CO_2$ refrigerant exiting receiving tank 6 (e.g., via fluid conduit 9) may be directed through $CO_2$ liquid line connection 138 and through expansion device 134. Expansion device 34 may allow the liquid $CO_2$ refrigerant to expand a lower pressure, lower temperature state. The expansion process may be an isenthalpic and/or adiabatic expansion process. The expanded $CO_2$ refrigerant may then be directed into AC evaporator 132. In some embodiments, expansion device 134 adjusts the amount of $CO_2$ provided to AC evaporator 132 to maintain a desired superheat temperature at (or near) the outlet of the AC evaporator 132. After passing through AC evaporator 132, the $CO_2$ refrigerant may be directed through suction line heat exchanger 137 and $CO_2$ liquid accumulator 139 to the suction (i.e., upstream) side of AC compressor 136.

Still referring to FIG. 3, one primary difference between AC module 30 and AC module 130 is that AC module 130, avoids the high pressure $CO_2$ inlet (e.g., from fluid conduit 3) as a source of $CO_2$. Instead, AC module 130 uses a lower-pressure source of $CO_2$ refrigerant supply (e.g., from fluid conduit 9). Fluid conduit 9 may be fluidly connected with receiving tank 6 and may operate at a pressure equivalent or substantially equivalent to the pressure within receiving tank 6. In some embodiments, fluid conduit 9 provides liquid $CO_2$ refrigerant having a pressure of approximately 38 bar.

In some implementations, AC module 130 may be used as an alternative or supplement to AC module 30. The configuration provided by AC module 130 may be desirable for implementations in which AC evaporator 132 is not mounted on a refrigeration rack with the components of $CO_2$ refrigeration system 100. AC module 130 may be used for implementations in which AC evaporator 132 is located elsewhere in the facility (e.g. near the AC loads). Additionally, the lower pressure liquid $CO_2$ refrigerant provided to AC module 130 (e.g., from fluid conduit 9 rather than from fluid conduit 3) may facilitate the use of lower pressure components for routing the $CO_2$ refrigerant (e.g. copper tubing/piping, etc.).

In some embodiments, AC module 130 may include a pressure-reducing device 135. Pressure reducing-device 135 may be a motor-operated valve, a manual expansion valve, an electronic expansion valve, or other element capable of effectuating a pressure reduction in a fluid flow. Pressure-reducing device 135 may be positioned in line with vapor line connection 140 (e.g., between fluid conduit 7 and intersection 141). In some embodiments, pressure-reducing device 135 may reduce the pressure at the outlet of AC evaporator 132. In some embodiments, the heat absorption process which occurs within AC evaporator 132 is a substantially isobaric process. In other words, the $CO_2$ pressure at both the inlet and outlet of AC evaporator 132 may be substantially equal. Additionally, the $CO_2$ vapor in fluid conduit 7 and the liquid $CO_2$ in fluid conduit 9 may have substantially the same pressure since both fluid conduits 7 and 9 draw $CO_2$ refrigerant from receiving tank 6. Therefore, pressure-reducing device may provide a pressure drop substantially equivalent to the pressure drop caused by expansion device 134.

In some embodiments, line connection 140 may be used as an alternate (or supplemental) path for directing $CO_2$ vapor from receiving tank 6 to the suction of AC compressor 136. Line connection 140 and AC compressor 136 may provide a more efficient mechanism of controlling the pressure in receiving tank 6 (e.g., rather than bypassing the $CO_2$ vapor to the suction side of the MT compressors 14, as described with reference to AC module 30), thereby increasing the efficiency of $CO_2$ refrigeration system 100.

Figure 4:
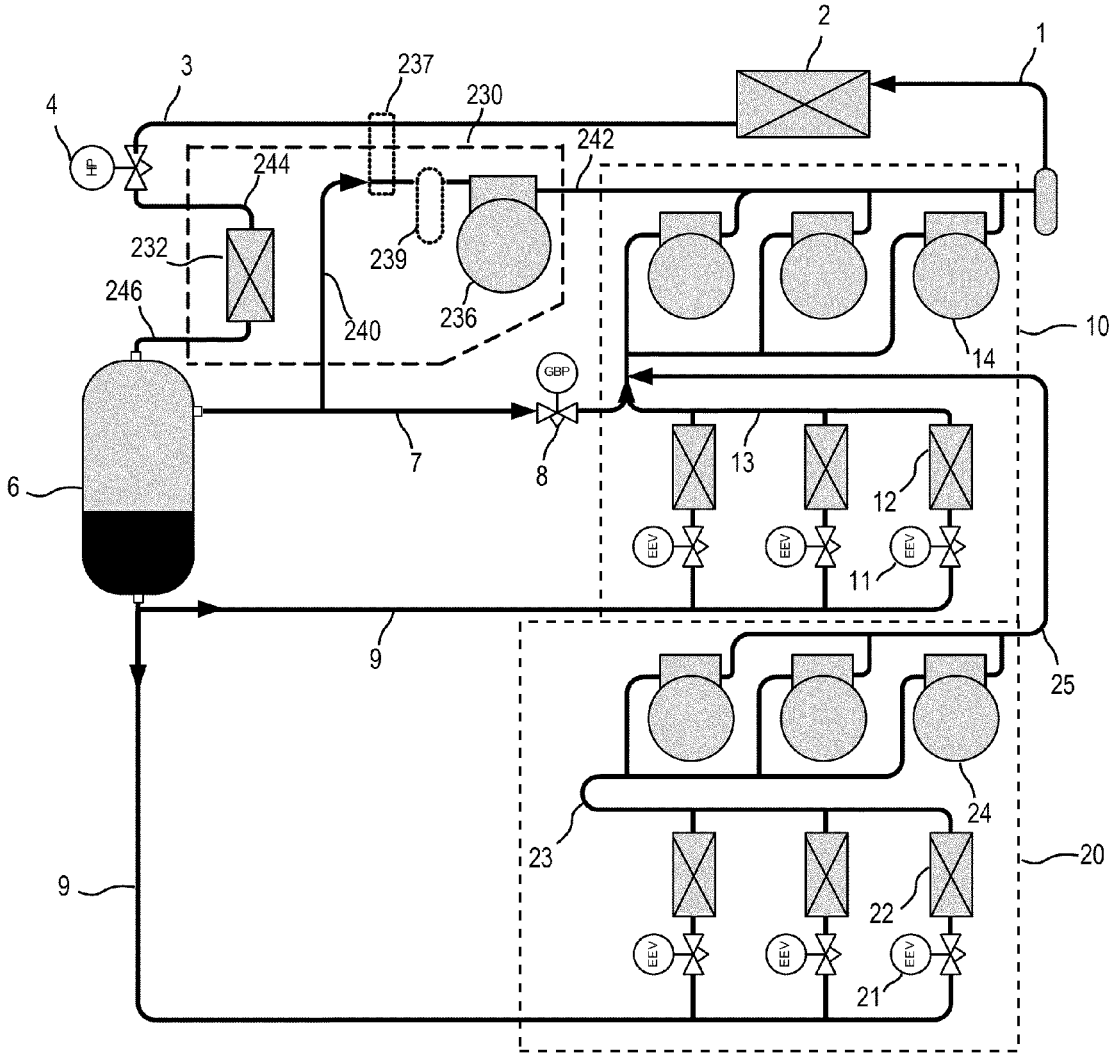
FIG. 4 is a schematic representation of the $CO_2$ refrigeration system of FIG. 1 having yet another flexible AC module for integrating cooling for air conditioning loads in the facility, according to another exemplary embodiment.

Referring now to FIG. 4, a flexible AC module 230 for integrating cooling loads in a facility with $CO_2$ refrigeration system 100 is shown, according to another exemplary embodiment. AC module 230 is shown to include an AC evaporator 232 (e.g., a liquid chiller, a fan-coil unit, a heat exchanger, etc.) and at least one AC compressor 236. In some embodiments, flexible AC module 30 further includes a suction line heat exchanger 237 and $CO_2$ liquid accumulator 239. AC evaporator 232, AC compressor 236, suction line heat exchanger 237, and $CO_2$ liquid accumulator 239 may be the same or similar to analogous components (e.g., AC evaporator 32, AC compressor 36, suction line heat exchanger 37, and $CO_2$ liquid accumulator 39) of AC module 30. AC module 230 does not require an expansion device as previously described with reference to AC modules 30 and 130 (e.g., expansion devices 34 and 134). The size and capacity of the AC module 230 may be varied to suit any intended load or application by varying the number and/or size of evaporators, heat exchangers, and/or compressors within AC module 230.

Advantageously, AC module 230 may be readily connectible to $CO_2$ refrigeration system 100 using a relatively small number (e.g., a minimum number) of connection points. According to an exemplary embodiment, AC module 30 may be connected to $CO_2$ refrigeration system 100 at two connection points: a $CO_2$ vapor line connection 240, and a $CO_2$ discharge line 242. $CO_2$ vapor line connection 240 is shown connecting to fluid conduit 7 and may receive (if necessary) $CO_2$ bypass gas from receiving tank 6. $CO_2$ discharge line 242 is shown connecting the output of AC compressor 236 to fluid conduit 1, which leads to gas cooler/condenser 2. Both of connections 240 and 242 may be readily facilitated using flexible hoses, quick disconnect fittings, highly compatible valves, and/or other convenient "plug-and-play" hardware components.

In some embodiments, AC module 230 has an inlet connection 244 and an outlet connection 246. Both inlet connection 244 and outlet connection 246 may connect (e.g., directly or indirectly) to respective inlet and outlet ports of AC evaporator 232. AC evaporator 232 may be positioned in line with fluid conduit 5 between high pressure valve 4 and receiving tank 6. AC evaporator 232 is shown receiving an entire mass flow of a the $CO_2$ refrigerant from gas cooler/condenser 2 and high pressure valve 4. AC evaporator 232 may receive the $CO_2$ refrigerant as a liquid-vapor mixture from high pressure valve 4. In some embodiments, the $CO_2$ liquid-vapor mixture is supplied to AC evaporator 232 at a temperature of approximately 3° C. In other embodiments, the $CO_2$ liquid-vapor mixture may have a different temperature (e.g., greater than 3° C., less than 3° C.) or a temperature within a range (e.g., including 3° C. or not including 3° C.).

Within AC evaporator 232, a portion of the $CO_2$ liquid in the mixture evaporates to chill a circulating AC coolant (e.g. water, water/glycol, or other AC coolant which expels heat to the $CO_2$ refrigerant). In some embodiments, the AC coolant may be chilled from approximately 12° C. to approximately 7° C. In other embodiments, other temperatures or temperature ranges may be used. The amount of $CO_2$ liquid which evaporates may depend on the cooling load (e.g., rate of heat transfer, cooling required to achieve a setpoint, etc.). After chilling the AC coolant, the entire mass flow of the $CO_2$ liquid-vapor mixture may exit AC evaporator 232 and AC module 230 (e.g., via outlet connection 246) and may be directed to receiving tank 6.

$CO_2$ refrigerant vapor in receiving tank 6 can exit receiving tank 6 via fluid conduit 7. Fluid conduit 7 is shown fluidly connected with the suction side of AC compressor 236 (e.g., by vapor line connection 240). In some embodiments, $CO_2$ vapor from receiving tank 6 travels through fluid conduit 7 and vapor line connection 240 and is compressed by AC compressor 236. AC compressor 236 may be controlled to regulate the pressure of $CO_2$ refrigerant within receiving tank 6. This method of pressure regulation may provide a more efficient alternative to bypassing the $CO_2$ vapor through gas bypass valve 8.

Advantageously, AC module 230 provides an AC evaporator that operates "in line" (e.g., in series, via a linear connection path, etc.) to use all of the $CO_2$ liquid-vapor mixture provided by high-pressure valve 4 for cooling the AC loads. This cooling may evaporate some or all of the liquid in the $CO_2$ mixture. After exiting AC module 230, the $CO_2$ refrigerant (now having an increased vapor content) is directed to receiving tank 6. From receiving tank 6, the $CO_2$ refrigerant and may readily be drawn by AC compressor 236 to control and/or maintain a desired pressure in receiving tank 6.

According to any exemplary embodiment, an AC module (e.g., AC module 30, 130, or 230) as described herein for use with $CO_2$ refrigeration system 100 provides a compact, inexpensive, easily installable and modular solution for enhancing the efficiency of the cooling systems (e.g., refrigeration systems and building zone cooling systems) in any type of facility implementing a refrigeration system and an AC system (e.g., supermarket facilities that are located in relatively warmer climates, etc.). The efficiency of the cooling systems may be enhanced by integrating the AC cooling loads with the $CO_2$ refrigeration system in a parallel compression arrangement.

Additionally, the parallel compression arrangement of the AC module with MT compressors 14 provides a more efficient method for controlling $CO_2$ pressure within receiving tank 6. For example, the AC module and/or AC compressor (e.g., AC compressor 36, 136, or 236) provide a more efficient use for excess $CO_2$ vapor in receiving tank 6 than bypassing the $CO_2$ vapor through gas bypass valve 8.

Further, the AC module operates in a relatively fail-safe manner in the event of malfunction or maintenance of the AC compressor. For example, by permitting $CO_2$ discharge flow from the AC evaporator to re-route through gas bypass valve 8 (e.g., via line connection 40 as shown in FIG. 2), the $CO_2$ refrigerant can be compressed by MT compressors 14. Advantageously, the parallel compression arrangement allows the AC module to maintain cooling and pressure regulation functionality in the event of an AC compressor failure. In some embodiments, the $CO_2$ refrigerant can be rerouted upon a sensed pressure increase in receiving tank 6 when the parallel AC compressor stops.

The AC module provides desired modularity by requiring only a minimum number of connection points (e.g., two connection points, three connection points, etc.) that are each readily connectable with the piping (e.g. on or at a "rack" of equipment) for $CO_2$ refrigeration system 100. The AC module also provides desired scalability by allowing a variety of sizes, numbers, and or capacities of evaporators, heat exchangers, and/or compressors within the AC module.

In some embodiments (e.g., as described with reference to FIG. 2), the AC module can be mounted in a refrigeration rack with various components of refrigeration system 100 to take advantage of the pressure differential between gas cooler/condenser 2 and receiving tank 6. In other embodiments (e.g., as described with reference to FIGS. 3-4), the AC module can be located remotely in a facility (e.g. nearer the AC loads) and supplied by conventional tubing and components by using the lower-pressure $CO_2$ liquid supply (e.g., via fluid conduit 7) from receiving tank 6. All such embodiments are intended to be within the scope of this disclosure.

In some embodiments, a control system or device provides all the necessary control capabilities to operate $CO_2$ refrigeration system 100 with and/or without the AC module. The control system or device can interface with suitable instrumentation associated with the system (e.g., timing devices, pressure sensors, temperature sensors, etc.) and provide appropriate output signals to operable components (e.g., valves, power supplies, flow diverters, etc.) to control the $CO_2$ pressure and flow within the system 100. For example, the control system may be configured to modulate the position of gas bypass valve 8 to maintain proper $CO_2$ pressure control within receiving tank 6 as the loading from the AC system within the facility changes (e.g. on a daily basis, seasonal basis, etc.).

In some embodiments, the control system or device may regulate, or control the $CO_2$ refrigerant pressure within gas cooler/condenser 2 by operating high pressure valve 4. The control system device may operate high pressure valve 4 in coordination with gas bypass valve 8 and/or other system components to facilitate improved control functionality and maintain a proper balance of $CO_2$ pressures and flows throughout system 100 (e.g., to achieve a desired pressure, temperature, flow rate setpoint, etc.). The control system or device may adaptively control the operable components of $CO_2$ refrigeration system 100 and/or AC modules 30, 130, and 230 to maintain the desired balance of pressures, temperatures and flow rates notwithstanding variation in system conditions. Such variation may include variation in refrigeration system conditions (e.g., refrigeration loads, number or type of MT or LT compressors, evaporators, expansion valves, etc.), variation in AC module conditions (e.g., cooling loads, AC number or type of AC compressors, evaporators, etc.) and/or variation in other conditions (e.g., the presence or absence of heat exchanger 37, 137, or 237, length and diameter of piping, etc.)

According to any exemplary embodiment, the control system or device contemplates methods, systems and program products on any non-tangible machine-readable media for accomplishing various operations including those described herein. The embodiments of the present disclosure may be implemented using existing computer processors, or by a special purpose computer processor for an appropriate system, incorporated for this or another purpose, or by a hardwired system.

Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the systems and methods for a $CO_2$ refrigeration system with an integrated AC module as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims.

The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. An integrated $CO_2$ refrigeration and air conditioning (AC) system for use in a facility, the integrated system comprising:

one or more $CO_2$ compressors configured to discharge a $CO_2$ refrigerant at a higher pressure for circulation through a circuit to provide cooling to one or more refrigeration loads in the facility;

a gas cooler/condenser configured to receive the $CO_2$ refrigerant from the one or more $CO_2$ compressors;

a high pressure valve configured to receive the $CO_2$ refrigerant from the gas cooler/condenser via a $CO_2$ liquid line connecting the gas cooler/condenser to the high pressure valve;

a receiver configured to receive the $CO_2$ refrigerant at a lower pressure, the receiver having a $CO_2$ liquid portion and a $CO_2$ vapor portion;

an AC module that provides cooling for a chilled AC coolant different from the $CO_2$ refrigerant and delivers the chilled AC coolant to AC loads in the facility, the AC module comprising:

an AC evaporator having an inlet configured to receive $CO_2$ liquid from the high pressure valve and an outlet configured to discharge a $CO_2$ vapor, wherein the AC evaporator provides the cooling for the chilled AC coolant by transferring heat from the chilled AC coolant to the $CO_2$ liquid, thereby causing a portion of the $CO_2$ liquid to evaporate forming the $CO_2$ vapor; and an AC compressor arranged in parallel with the one or more $CO_2$ compressors, the AC compressor configured to receive the $CO_2$ vapor from the receiver; and a $CO_2$ vapor line connecting the AC evaporator to the $CO_2$ vapor portion of the receiver and configured to provide the $CO_2$ vapor discharged from the AC evaporator to the $CO_2$ vapor portion of the receiver;

wherein the high pressure valve is controllable to maintain a target pressure of the $CO_2$ refrigerant; and wherein the one or more refrigeration loads are different from the AC loads.

2. The integrated system of claim 1, further comprising:

a suction line heat exchanger disposed between the AC evaporator and the AC compressor, the suction line heat exchanger configured to receive the higher pressure $CO_2$ refrigerant as a heat source.

3. The integrated system of claim 2, further comprising:

a $CO_2$ liquid accumulator disposed between the suction line heat exchanger and the AC compressor.

4. The integrated system of claim 1, further comprising:

a control system operable to control an amount of $CO_2$ vapor directed from the receiver to a suction of the AC compressor and from the receiver to a suction of the $CO_2$ compressors.

5. The integrated system of claim 1 wherein the AC module is integrated into the $CO_2$ refrigeration system by three piping connections.

6. An integrated $CO_2$ refrigeration and air conditioning (AC) system for use in a facility, the integrated system comprising:

a $CO_2$ refrigeration circuit configured to circulate a $CO_2$ refrigerant to refrigeration loads in the facility, the CO2 refrigeration circuit including:

a plurality of parallel $CO_2$ compressors, a gas cooler/condenser, a receiver having a $CO_2$ vapor portion and a $CO_2$ liquid portion, a high pressure valve positioned downstream of the gas cooler/condenser and upstream of the receiver;

a $CO_2$ liquid transport line coupled to the gas cooler/condenser and the high pressure valve, the $CO_2$ liquid transport line configured to receive $CO_2$ liquid from the gas cooler/condenser and to provide the $CO_2$ liquid to the high pressure valve;

a $CO_2$ liquid supply line coupled to the $CO_2$ liquid portion of the receiver and configured to direct $CO_2$ liquid to one or more refrigeration loads in the facility; and an AC module that provides cooling for a chilled AC coolant different from the CO2 refrigerant and delivers the chilled AC coolant to AC loads in the facility, the AC module comprising:

an AC evaporator having an inlet configured to receive the $CO_2$ refrigerant from the high pressure valve and an outlet configured to discharge the $CO_2$ refrigerant, wherein the AC evaporator provides the cooling for the chilled AC coolant by transferring heat from the chilled AC coolant to the $CO_2$ refrigerant, thereby causing a portion of the $CO_2$ refrigerant to evaporate forming $CO_2$ vapor;

an AC compressor arranged in parallel with the plurality of parallel $CO_2$ compressors, the AC compressor configured to receive $CO_2$ vapor from the AC evaporator and from the receiver; and a $CO_2$ vapor line connecting the AC evaporator to the $CO_2$ vapor portion of the receiver and configured to provide the $CO_2$ vapor from the AC evaporator to the $CO_2$ vapor portion of the receiver;

wherein the high pressure valve is controllable to maintain a target pressure of the $CO_2$ liquid; and wherein the refrigeration loads are different from the AC loads.

7. The integrated system of claim 6, wherein the AC compressor is configured to at least partially regulates a $CO_2$ pressure within the receiver.

8. The integrated system of claim 6, wherein upon a loss of suction at the AC compressor, the $CO_2$ refrigerant is directed through a gas bypass valve to the plurality of parallel $CO_2$ compressors.

9. An integrated $CO_2$ refrigeration and air conditioning (AC) system for use in a facility, the integrated system comprising:

a $CO_2$ refrigeration circuit configured to circulate a $CO_2$ refrigerant to refrigeration loads in the facility, the $CO_2$ refrigeration circuit including:

a $CO_2$ compressor configured to discharge the $CO_2$ refrigerant at a first pressure into a first fluid line, a receiver configured to receive the $CO_2$ refrigerant at a second pressure lower than the first pressure, the receiver having a $CO_2$ liquid portion and a $CO_2$ vapor portion, and a high pressure valve disposed between the $CO_2$ compressor and the receiver, the high pressure valve configured to receive the $CO_2$ refrigerant at the first pressure from a second fluid line and discharge the $CO_2$ refrigerant at the second pressure;

a gas cooler/condenser located upstream of the high pressure valve and downstream of the $CO_2$ compressor, the gas cooler/condenser configured to receive the $CO_2$ refrigerant from the first fluid line, the gas cooler/condenser further configured to discharge the $CO_2$ refrigerant into the second fluid line;

an AC module integrated with the $CO_2$ refrigeration circuit, wherein the AC module provides cooling for a chilled AC coolant different from the $CO_2$ refrigerant and delivers the chilled AC coolant to AC loads in the facility, the AC module including:

an AC evaporator configured to receive $CO_2$ refrigerant from the high pressure valve, wherein the AC evaporator provides the cooling for the chilled AC refrigerant by transferring heat from the chilled AC coolant to the $CO_2$ refrigerant, thereby causing a portion of the $CO_2$ refrigerant to evaporate forming $CO_2$ vapor;

an AC compressor arranged in parallel with the $CO_2$ compressor, the AC compressor configured to receive $CO_2$ vapor from the $CO_2$ vapor portion of the receiver and to discharge vapor $CO_2$ refrigerant into the first fluid line; and a $CO_2$ vapor line connecting the AC evaporator to the $CO_2$ vapor portion of the receiver and configured to provide the $CO_2$ vapor from the AC evaporator to the $CO_2$ vapor portion of the receiver;

wherein the high pressure valve is controllable to maintain a target pressure of the $CO_2$ refrigerant; and wherein the refrigeration loads are different from the AC loads.

10. The integrated system of claim 9, wherein the component of the $CO_2$ refrigeration circuit from which the AC evaporator receives $CO_2$ refrigerant is the second fluid line, the system further comprising:

a first $CO_2$ vapor line fluidly coupling the $CO_2$ vapor portion of the receiver to an outlet of the AC evaporator, and a second $CO_2$ vapor line fluidly coupling the outlet of the AC evaporator to the inlet of the AC compressor.

11. The integrated system of claim 9, wherein the component of the $CO_2$ refrigeration circuit from which the AC evaporator receives $CO_2$ refrigerant is the high pressure valve, wherein the AC evaporator is arranged in an in line configuration to receive an entire mass flow of the $CO_2$ refrigerant from the high pressure valve.

* * * * *